US006745520B2

(12) United States Patent
Puskaric et al.

(10) Patent No.: US 6,745,520 B2
(45) Date of Patent: Jun. 8, 2004

(54) INTEGRATED RAPID ACCESS ENTRY/ EGRESS SYSTEM

(76) Inventors: John L. Puskaric, 511 Burkes Dr., Coraopolis, PA (US) 15108; Frank C. Yesh, 2941 Seminary Dr., Greensburg, PA (US) 15601

( * ) Notice: Subject to any disclaimer, the term of this patent is extended or adjusted under 35 U.S.C. 154(b) by 45 days.

(21) Appl. No.: 10/143,159

(22) Filed: May 10, 2002

(65) Prior Publication Data

US 2003/0208966 A1 Nov. 13, 2003

(51) Int. Cl.[7] ..... E04B 1/346; E04B 7/16

(52) U.S. Cl. ..... 52/64; 52/174; 52/29; 49/68; 49/142; 49/143; 49/24; 49/324

(58) Field of Search ..... 52/64, 174, 29; 49/68, 142, 143, 144, 24, 324

(56) References Cited

U.S. PATENT DOCUMENTS

| | | | | |
|---|---|---|---|---|
| 1,184,725 | A | | 5/1916 | Dawes |
| 3,380,191 | A | | 4/1968 | Neeff et al. |
| 3,742,647 | A | | 7/1973 | Tomita |
| 3,967,411 | A | | 7/1976 | Ulmann |
| 4,136,641 | A | | 1/1979 | Hoffman |
| 4,256,164 | A | | 3/1981 | Agcaoili |
| 4,261,297 | A | | 4/1981 | Van Maarion et al. |
| 4,324,072 | A | | 4/1982 | Sterner, Jr. |
| 4,375,735 | A | | 3/1983 | Rhoads |
| 4,376,352 | A | | 3/1983 | Soininen et al. |
| RE31,721 | E | | 11/1984 | Sterner, Jr. |
| 4,481,887 | A | | 11/1984 | Urbano |
| 4,534,395 | A | | 8/1985 | Carroll |
| 4,598,495 | A | | 7/1986 | Labarile |
| 4,656,954 | A | * | 4/1987 | Tonali ..... 109/6 |
| 4,718,205 | A | | 1/1988 | Taylor |
| 4,799,528 | A | | 1/1989 | Benitez |
| 4,909,052 | A | | 3/1990 | Hutwohl |
| 4,926,531 | A | | 5/1990 | Koslowski et al. |
| 5,183,008 | A | | 2/1993 | Carrano |
| 5,212,909 | A | | 5/1993 | Morin |
| 5,325,084 | A | | 6/1994 | Timm et al. |
| 5,335,710 | A | | 8/1994 | Belanger |
| 5,694,867 | A | | 12/1997 | Diaz-Lopez |
| 5,769,011 | A | | 6/1998 | Daniel |
| 5,802,783 | A | * | 9/1998 | Bayha ..... 52/204.5 |
| 5,845,692 | A | | 12/1998 | Kellem et al. |
| 5,899,303 | A | | 5/1999 | Allen |
| 5,921,191 | A | | 7/1999 | Gabel |
| 5,992,094 | A | | 11/1999 | Diaz |
| 6,076,303 | A | | 6/2000 | Orsini |
| 6,119,096 | A | | 9/2000 | Mann et al. |

(List continued on next page.)

FOREIGN PATENT DOCUMENTS

| | | | |
|---|---|---|---|
| CH | 669 685 | A | 3/1989 |
| EP | 0 268 924 | A | 6/1998 |
| FR | 2 571 419 | A1 | 4/1986 |
| WO | WO 00 23958 | A | 4/2000 |

OTHER PUBLICATIONS

Internet Printout from www.secureaccessportals.com.

*Primary Examiner*—Carl D. Friedman
*Assistant Examiner*—Nahid Amiri
(74) *Attorney, Agent, or Firm*—Thorp Reed & Armstrong, LLP

(57) ABSTRACT

An integrated rapid access entry/egress apparatus, system, and method for controlling and directing the movement of people or objects between unsecured and secured areas using a plurality of panels is provided. Sensors detect a person's approach and entrance into the system or apparatus. An approval means alerts a processor as to whether the person is approved or not approved. The panels move to direct approved persons to a secured area and not approved persons to an unsecured area so as not to impede the flow of traffic through the apparatus or system. The apparatus accommodates bi-directional traffic and provides an effective and efficient access system.

34 Claims, 17 Drawing Sheets

U.S. PATENT DOCUMENTS 6,128,875 A 10/2000 Quaintance
6,176,292 B1 1/2001 Norton, II
6,298,603 B1 10/2001 Diaz
6,308,644 B1 * 10/2001 Diaz ..... 109/6
D450,858 S 11/2001 Brunetti et al.
6,352,097 B1 3/2002 Kern et al.
2002/0046917 A1 * 4/2002 Okano et al.

* cited by examiner

INTEGRATED RAPID ACCESS ENTRY/ EGRESS SYSTEM

BACKGROUND OF THE INVENTION

1. Field of the Invention

The present invention is directed to the field of access control systems and, more particularly, to an apparatus, a system, and a method for controlling and directing the movement of people or objects between unsecured and secured areas.

2. Description of the Background

There is an increasing need and desire to control access to certain areas depending on whether a person is approved to enter that area, without impeding the general flow of traffic in the surrounding areas. An access control system should be able to be customized to a user's preferences, enabling its use in a variety of environments, including airports, power plants, manufacturing facilities, research facilities, prisons, office buildings, etc. Such a system should require minimal human supervision, be universally understandable, and be very user-friendly.

Current access control systems suffer the problems of: (1) impeding or slowing the movement of traffic; (2) requiring a large staff to run the system; (3) requiring two systems in any given area, one for traffic in each direction; (4) lacking the ability to be customized to a user's security needs; (5) lacking the ability to be customized to a user's aesthetic desires; (6) being dangerous; (7) lacking compatibility with current bag or luggage processing technologies; and (8) causing damage to the surroundings during installation. One or more of these problems are prevalent in current and past access control systems.

U.S. Pat. No. 5,845,692 to Kellem et al. (the "'692 patent") is one of the more advanced patented access control systems. The '692 patent discloses a rapid access door system in which authorized individuals pass through bi-fold doors to a secure area and unauthorized individuals are directed through a side door to an unsecured area. The '692 patent suffers from many of the above-identified problems. The use of bi-fold doors, with exposed moving hinges that extend into the path of a person walking towards the doors, poses multiple dangers. First, the exposed hinges and the three pivot axes present numerous opportunities for fingers, toes, shoes, etc. to get caught, pinched, and cut. Second, the lead edges of the bi-fold doors close toward the person walking through the '692 patented portal, thus threatening to catch the person between the closing doors and cause injury. The design of the bi-fold doors' lead edges and the design of the bi-fold doors' closing direction creates a funnel-like area that draws a person into a smaller and smaller pinch point.

Additional pinch points exist in the '692 patented invention where the doors swing toward and away from the frame and at the point where the hinges are fastened to the frame. Similar to the funnel shaped area created by the closing doors, as the doors open they create two pinch points between the doors and the exterior of the door control modules. More specifically, those pinch points are located between the doors, the frame, and the hinges. Additional pinch points occur where the linked sliding door panels enter the door control modules. The door panels sliding into and out of the door control modules create opportunities for the dragging and pinching of fingers, skin, loose clothing, or jewelry. Finally, the space between the bottom of the doors, or the sliding panels, and the floor creates an area in which shoes and feet can be pinched and scratched.

Without extreme modifications, the '692 patent does not accommodate bi-directional traffic. The authorization means and side opening are located on just one side of the bi-fold door. That, in combination with the fact that there is only one entrance that lacks a door, limits the movement of traffic through the system to one direction. Therefore, any lobby or entrance area accommodating two-way traffic needs two of the systems described in the '692 patent.

The '692 patent discloses a pair of bi-fold doors that alternatively block one of two different openings. Therefore, at all times, one opening is unrestricted and one opening is blocked. The '692 patented system cannot be used to enclose a person, should the user desire that option. Nor can the '692 patented system be used with all doorways open.

Thus, a need exists to advance the current technology related to access control systems to solve the above-identified problems. In particular, a need exists for an access control system that is safe, is customizable, is adaptable to a variety of environments, improves traffic flow, and requires minimal human supervision.

SUMMARY OF THE PRESENT INVENTION

The present invention is directed to an apparatus, a system, and a method for controlling and directing the movement of people and objects by using a plurality of panels, doors, or door-like structures. In one embodiment, the present invention is directed to an apparatus having a first pair of end barriers defining an entrance. The first pair of end barriers moves between a first position in which the entrance is open and a second position in which the entrance is blocked. A second pair of end barriers defines an end egress located opposite and spaced apart from the entrance so as to define a walkway therebetween. The second pair of end barriers moves between a first position in which the end egress is open and a second position in which the end egress is blocked. A first side barrier defines a first side egress relative to the walkway. The first side barrier moves between a first position in which the first side egress is open and a second position in which the first side egress is blocked. Finally, one or more support structures hold the barriers in an upright manner and facilitate movement of the barriers between the barriers' respective first and second positions. The apparatus of the present invention can be customized to a user's needs and wants. Options for customizing the present invention will be apparent from the description of the preferred embodiments herein.

One embodiment of the present invention is directed to a method of controlling traffic with a plurality of panels. Alternatively, a plurality of doors or door-like structures may be used as a substitute for or in conjunction with the plurality of panels. A first pair of panels separating an unsecured area from a walkway moves from an open position to a blocked position after a person passes therethrough. The person is then approved or disapproved. If the person is approved, a second pair of panels separating the walkway from a secured area moves from an open position to a blocked position after the approved person passes therethrough. Otherwise, the second pair of panels separating the walkway from the secured area moves from an open position to a blocked position before the person can pass therethrough. The person is directed from the walkway to a second unsecured area and a first side panel separating the second unsecured area from the walkway moves from an open position to a blocked position after the person passes therethrough. The present invention also is directed to moving the second pair of panels separating the walkway from the secured area from the open position to the blocked position before the person can pass therethrough, and moving the first side panel separating the second unsecured area from the walkway from the open position to the blocked position, thereby trapping the person within the panels.

Another embodiment of the present invention is directed to a system having a first pair of panels defining an entrance. The first pair of panels moves between a first position in which the entrance is open and a second position in which the entrance is blocked. The first pair of panels connects a walkway with a first unsecured area. A second pair of panels defines an end egress located opposite the entrance at the end of the walkway. The second pair of panels moves between a first position in which the end egress is open and a second position in which the end egress is blocked. The second pair of panels connects the walkway with a secured area. A first side panel defines one edge of a first side egress from the walkway. The first side panel moves between a first position in which the first side egress is open and a second position in which the first side egress is blocked. The first side panel connects the walkway with a second unsecured area.

The present invention offers many advantages over the prior art. Because the present invention does not employ bi-fold doors, there are no exposed hinges or pinch points that endanger users. The present invention's panels close away from the user, thus giving the user sufficient time and warning to stop his or her movement towards the end egress. The present invention employs separate panel(s) for each entrance or egress. As a result, the panels can be positioned to close all or none of the passages at any given time. This gives the present invention the unique capability of confining people within the apparatus. Additionally, because all of the panels can be left in an open position, the present invention can also act like a passive walkthrough area.

The structural differences between the present invention and the prior art give the present invention several distinct advantages over the existing technology. The present invention's panels may be configured to remain slightly ajar, thus eliminating the "jaws of death" problem experienced with some existing access control technology. The parallel panels may be placed in or on channels, thus requiring less power to actuate the panels than heavier, more complicated bi-fold doors and other door structures. Additionally, because the panels are lighter in weight and require less power to actuate than do bi-fold doors, the panels can be closed with less force thus, protecting users from being "slammed" between the doors. A final advantage of using lighter weight panels (as opposed to bi-fold and other door structures) is that the present invention is more easily adapted to a mobile unit.

The present invention's entrance is equipped with a pair of panels preventing a person from exiting the walkway through the entrance once the person has entered the walkway. These entrance panels also prevent those people waiting in the queue from entering the walkway too quickly. The present invention works with all panels open as the default, with all panels blocking the entrance and egresses as the default, or with a combination of the entrance and egresses in the open or blocked position depending on the user's preference. When in motion, the present invention's panels intrude into less of the walkway than do bi-fold doors, thus, posing less of a safety risk to people walking quickly across the walkway. The present invention accommodates two-way traffic. Thus, a lobby or other area requires one of the present invention, instead of needing two of the competing technologies.

The exposed elements of the present invention can be constructed entirely out of non-metallic materials, such as panels made from a polycarbonate laminate and a support structure made from a thermoset polymer composite, an elastomeric polymer composite, a thermoplastic polymer composite, a non-reinforced polymer, or a metal-plastic hybrid. This is useful to users who desire to have the present invention customized to be used with metal detectors.

Another advantage of the present invention is that its basic design makes it handicapped accessible. This is not true of all prior art technologies, particularly technologies employing revolving doors and other complicated door-like structures. This also eliminates the need of having additional door structures available to accommodate handicapped individuals or individuals pushing strollers, etc. Additionally, the present invention may be modified to employ a conveyor belt or moving walkway instead of a stationary walkway. Such a modification allows the present invention to process people or objects. Those advantages and benefits, and others, will be apparent from the description of the preferred embodiments herein below.

BRIEF DESCRIPTION OF THE DRAWINGS

For the present invention to be easily understood and readily practiced, the present invention will now be described, for purposes of illustration and not limitation, in conjunction with the following figures, wherein.

DESCRIPTION OF THE PREFERRED EMBODIMENTS

Figure 1:
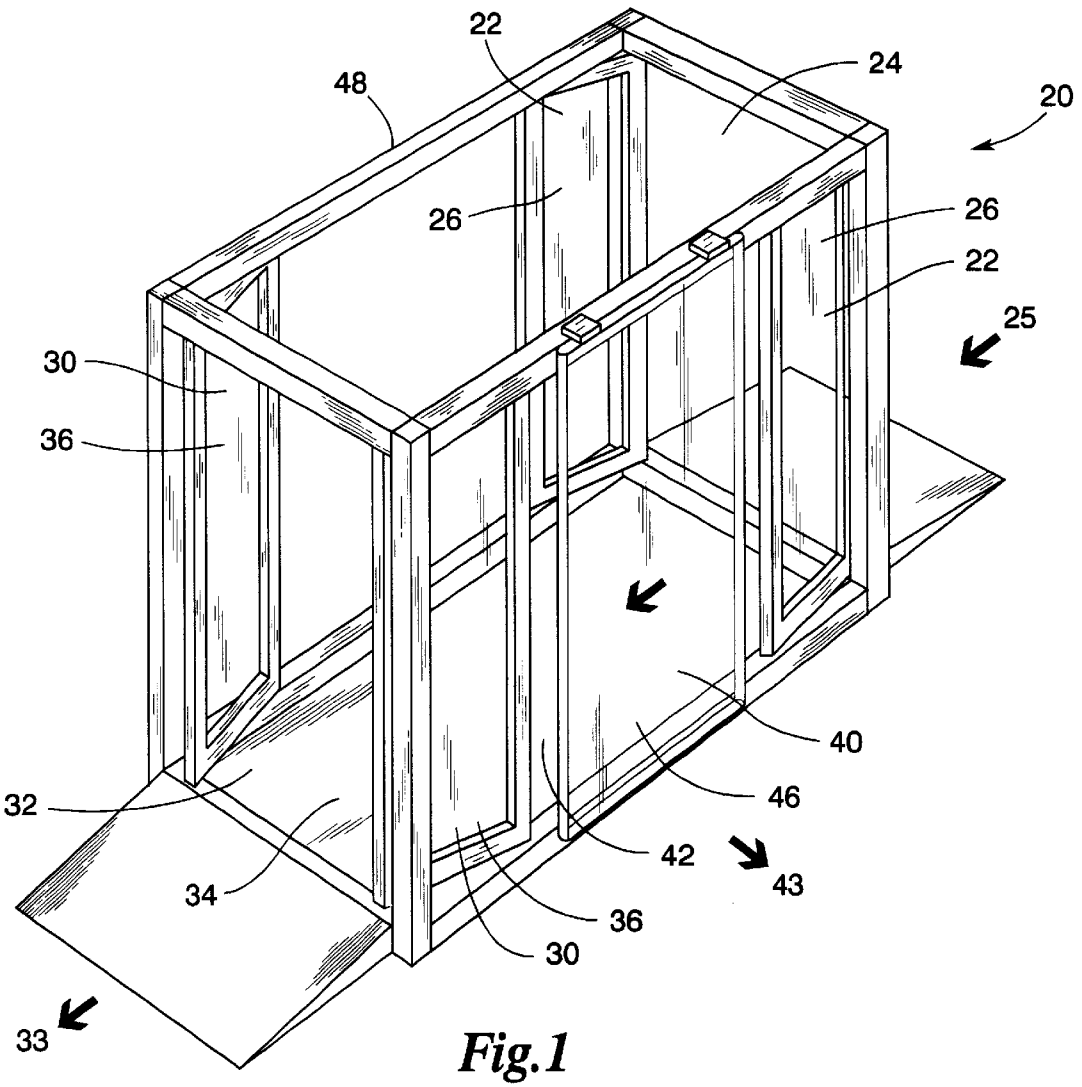
FIG. 1 is a perspective view of an embodiment of the present invention having one side egress.

The present invention is directed to a rapid access entry/egress apparatus (20) as shown in FIG. 1. The apparatus (20)

has a first pair of panels (22) defining an entrance (24). The entrance (24) separates a first unsecured area (25) from a walkway (34), which spans the interior of the apparatus (20). The first pair of panels (22) moves between two positions, a first position (26) in which the first pair of panels (22) allow a person to travel through the entrance (24) from the first unsecured area (25) to the walkway (34), and a second position (28) (see FIG. 2) in which the first pair of panels (22) restricts a person's movement through the entrance (24). Directly opposite from the entrance (24) is a second pair of panels (30) defining an end egress (32). The second pair of panels (30) moves between two positions, a first position (36) in which a person can pass through the end egress (32) to a secured area (33) and a second position (38) (see FIG. 2) in which the second pair of panels (30) restrict a person's passage to the secured area (33). The symmetrical structure of the entrance (24) and end egress (32) gives the apparatus (20) the unique ability to handle bi-directional traffic.

If, once inside the apparatus (20), the person is not approved for access to the secured area (33) the person passes through a first side egress (42) defined by a first side panel (40) that is in a first position (44) and into a second unsecured area (43). After the person has passed into the second unsecured area (43), the first side panel (40) slides into a second position (46) blocking the first side egress (42), thereby preventing the person from re-entering the apparatus (20) through the first side egress (42).

All of the panels are held in an upright position by a support structure (48) defining a rectangle or a square. In the preferred embodiment, the support structure (48) will contain a plurality of channels (58) (see FIG. 6B). Each panel is adapted to move in a linear manner on top, along, and/or within these channels (58). For example, the channels for the side panel (40) may be located along that side of the support structure (48) or they may be located along the top and the bottom of the corresponding parts of the support structure (48). The panels can be equipped with any currently available mechanism (such as a shaft and bushing) to enable the panels to slide along the channels (58). The channels (58) for the bottoms of the panels would be located in the top surface of the bottom portions of the support structure (48) or along a raised side edge of the bottom portion of the support structure (48). The channels (58) and the shape of the support structure (48) restrict the panels' movement between each panel's respective first and second positions.

In an alternative embodiment, the support structure (48) holds the first pair of panels (22) and the second pair of panels (30) in an upright position. The first side panel (40) is supported by a separate structure and is connected to a separate power source. This embodiment presents a safety option in case the power to the paired panels is interrupted. The first side panel (40) could be moved by an independent power source, linkage, or manually to prevent a person from being trapped in the apparatus (20).

It is also important to note, that the preferred embodiment of the present invention is directed to a system and apparatus that employs panels to control and direct traffic. Panels have certain attributes making them ideal for certain embodiments of the present invention. These attributes are discussed throughout the Summary of the Present Invention and in the Description of the Preferred Embodiments. For certain situations, it may be preferable to use traditional doors or other door-like structures, such as turnstiles, revolving doors, moving bars, and gates. Such alternatives lack many of the attributes discussed herein but offer other attributes such as reduced cost. The present invention is not limited to the use of panels, but encompasses the use of any door or door-like structure used in conjunction with the other elements of the invention to control and direct traffic between secured and unsecured areas.

The panels can be constructed out of a variety of materials depending on the needs of the user. Ideally, the panels would be made of a transparent material, such as a polycarbonate laminate, which allows people traveling through the apparatus to see what is going on around them and allows security personnel to monitor people inside the apparatus. The panels may be made out of a bullet or explosion resistant material. Additionally, sensors may be constructed into at least one edge of each panel. The sensors detect if someone or something is caught between the edges of the panels. A processor (76) then directs panel drive units (78) (see FIGS. 9A and 9B) to stop the panels' movement.

In the current embodiment, when a person approaches the apparatus (20), all of the panels are in their first position (i.e. all panels are open). Within the scope of the present invention, "open" refers to panels that are in their respective first positions allowing a person to pass between the panel(s) and through the entrance (24), the end egress (32), and/or the first side egress (42). Within the scope of the present invention, "closed" or "blocked" refers to panels that are in their respective second position restricting a person's movement through the entrance (24), the end egress (32), and/or the first side egress (42). Blocked does not necessarily refer to panels that are completely shut (i.e. that the edges of the panels touch). Here, "blocked" is intended to refer to panels positioned so that a person is unable to pass between the edges of the panels and through the entrance (24), the end egress (32), or the first side egress (42). In some circumstances though, it may be desirable to have the panels close completely. Such a structure is also encompassed by the present invention. It should also be noted that the entrance (24) and end egress (32) are not specific openings, but are determined according to the direction the person is traveling through the apparatus (20). Because the apparatus (20) accommodates bi-directional traffic, the entrance (24) when a person travels through the apparatus (20) in one direction becomes the end egress (32) when a person travels through the apparatus (20) in the opposite direction. The function of the entrance (24), end egress (32), and side egresses (42, 52) may be altered while remaining within the scope of the present invention. For example, a person may also enter the apparatus (20) via a side egress (42, 52) and exit via the entrance (24) or end egress (32).

After the person has passed through the first pair of panels (22) and into the apparatus (20), he or she is standing on the walkway (34). The first pair of panels (22) moves from their first position (26) to their second position (28). In their second position (28), the first pair of panels (22) prevents the person from turning around and exiting the apparatus (20) through the entrance (24). At this point, the second pair of panels (30) can remain in their first position (36) or move to their second position (38) according to the user's preference. In either situation, the first side panel (40) remains in its first position (44). If the person is approved to access the secured area (33), then the second pair of panels (30) and the first side panel (40) remain in their respective first positions while the person passes through the end egress (32) and into the secured area (33). If the person is not approved for access to the secured area (33), the second pair of panels (30) moves to their second position (38), thus forcing the person through the first side egress (42).

In an alternative embodiment, after the second pair of panels (30) move into their second position (38), the first side panel (40) moves into its second position (46) thereby trapping the not approved person within the apparatus (20).

Figure 2:
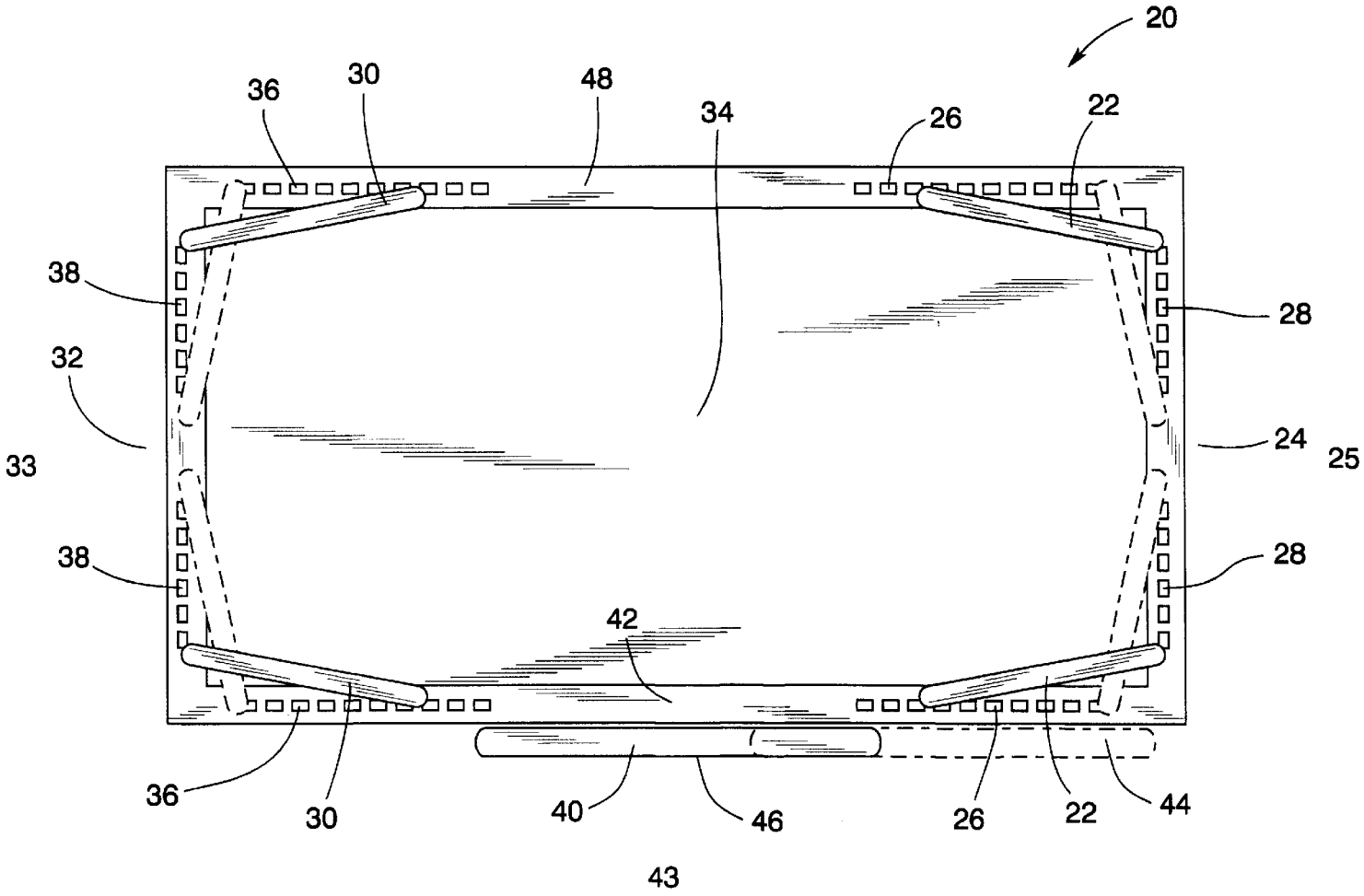
FIG. 2 is a schematic top view diagram of the embodiment of the present invention illustrated in FIG. 1.

FIG. 2 is a schematic top view diagram of the embodiment of the present invention illustrated in FIG. 1. FIG. 2 illustrates the respective first and second positions of all panels. Also, FIG. 2 illustrates that when the paired panels are in their second (blocked) position, their edges do not meet. This aspect of the present invention eliminates the problems of people's finger, toes, shoes, etc. being caught between the panels and makes the present invention safer than much of the prior art technology. Specifically, this is a distinct advantage over the prior art in which door structures have been known to cut or hit the people passing between them. FIG. 2 also demonstrates that the paired panels, as they move from their first position to their second position, move away from the person walking through the apparatus (20). A distinct advantage to using individual panels that move in this rectilinear manner is that the panels occupy very little of the actual walkway (34). As such, the panels do not pose many of the dangers inheritant in using the door structures of the prior art.

Figure 3:
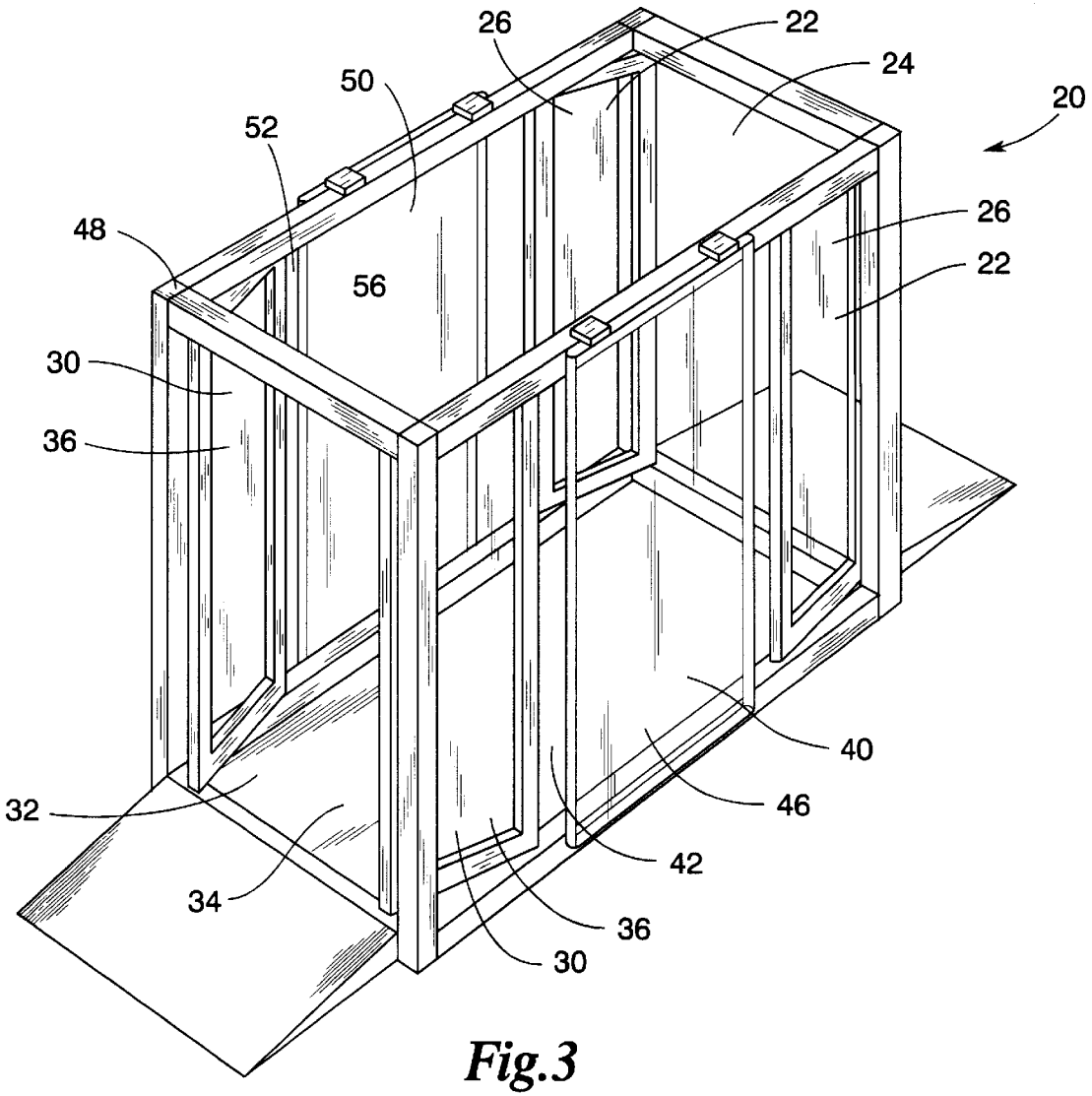
FIG. 3 illustrates another embodiment of the present invention having two side egresses.
Figure 4:
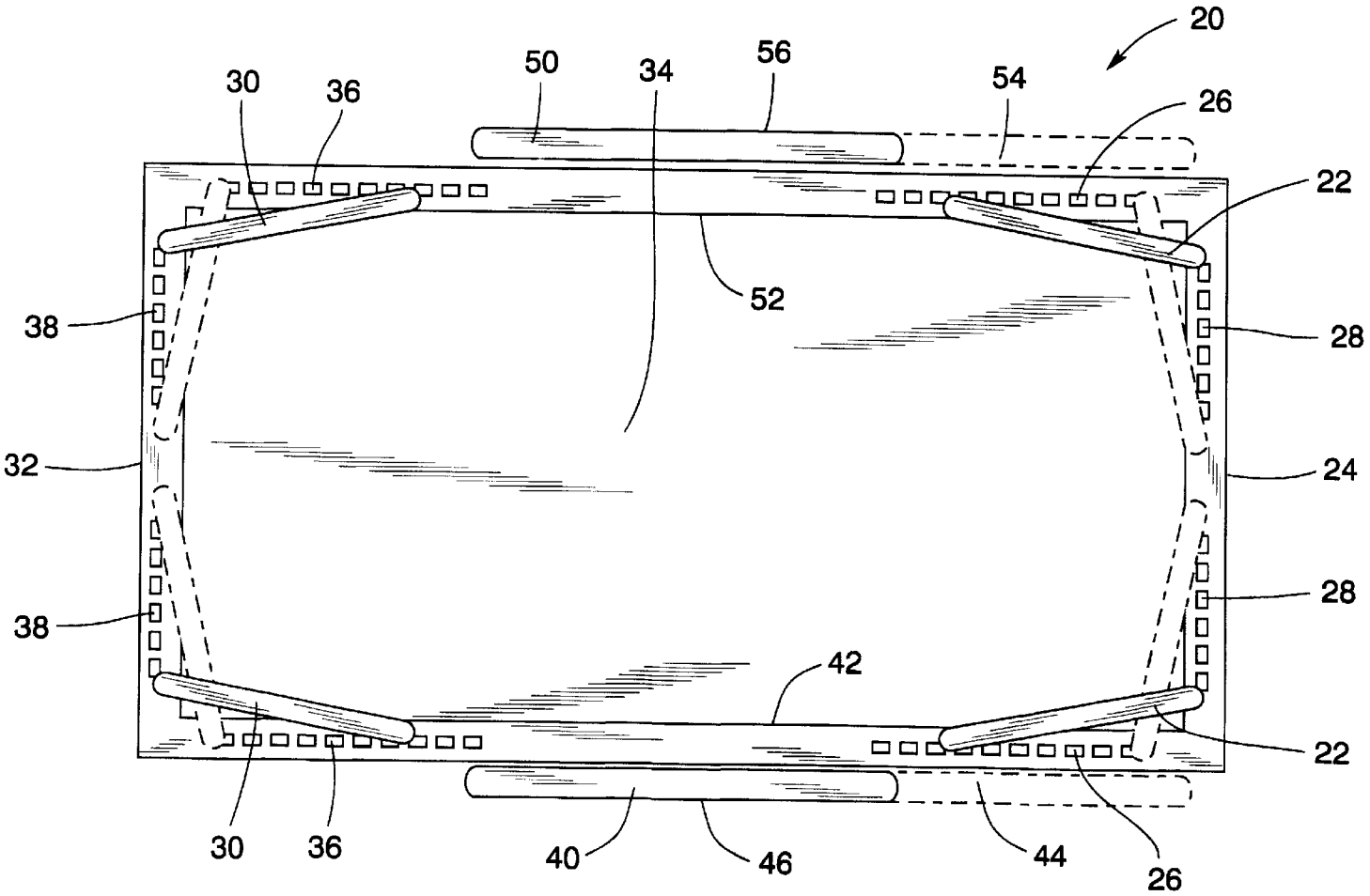
FIG. 4 is a schematic top view diagram of the embodiment of the present invention illustrated in FIG. 3.

FIG. 3 illustrates another embodiment of the present invention having two side egresses. FIG. 3 is similar to FIG. 1 except that opposite the first side panel (40) is a second side panel (50). The second side panel (50) defines a second side egress (52). The second side panel (50) moves between a first position (54) (as shown in FIG. 4) in which the second side egress (52) is open and a second position (56) in which the second side egress (52) is blocked. This option is advantageous in areas where a larger number of people are expected to not be approved for admission to the secured area (33). Individuals passing through the apparatus (20) could alternate which side egress they exited, thereby allowing security personnel manning those side egress sufficient time to inspect or approve the people who are being shuttled to the second unsecured areas (43).

FIG. 4 is a schematic top view diagram of the embodiment of the present invention that was illustrated in FIG. 3. FIG. 4 illustrates the movement of all the panels in their respective first and second positions. The movements of the panels illustrated in FIG. 4 are similar to the movements of the panels as discussed in conjunction with FIG. 2. For example, FIG. 4 demonstrates that the panels, in their second positions, do not close completely, nor do the moving panels intrude to any great extent into the walkway (34).

Figure 5:
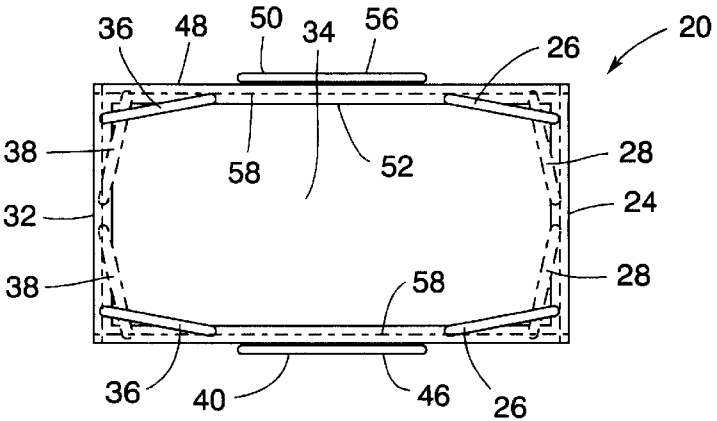
FIG. 5 is a top view of the embodiment of the present invention illustrated in FIGS. 3 and 4.

FIG. 5 is a top view of the embodiment of the present invention illustrated in FIG. 3. FIG. 5 shows the channels (58), which guide and restrain the movement of the panels. In the current embodiment, the channels are disposed in the support structure (48) of the apparatus (20).

Figure 6B:
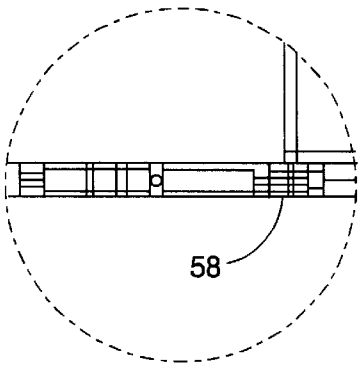
FIG. 6B is a detailed view of one corner and channel construction as shown in FIG. 6A.
Figure 6A:
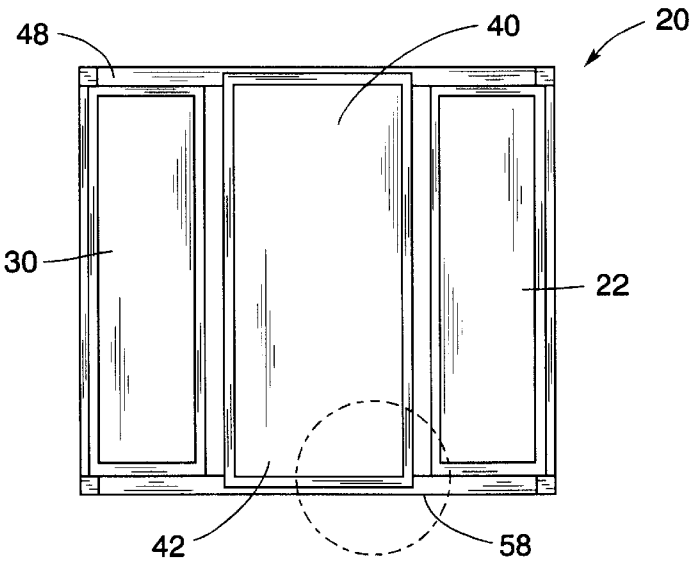
FIG. 6A is a side view of an embodiment of the present invention illustrating a side egress.

FIG. 6A is a side view of the apparatus (20) illustrating a side egress. FIG. 6A could be illustrating the first side egress (42) or the second side egress (52), because opposing sides of the apparatus (20) are generally symmetrical in structure. FIG. 6B is a detailed view of one panel and channel construction as shown in FIG. 6A.

Figure 7:
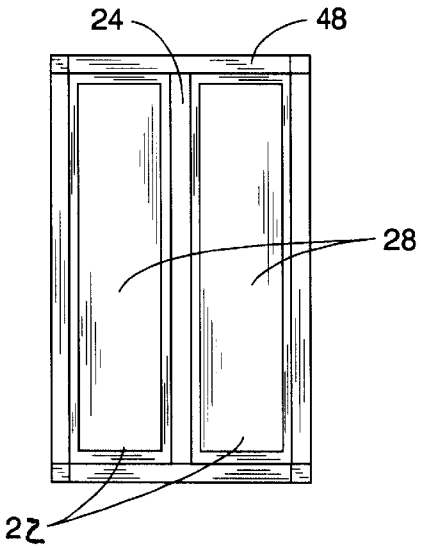
FIG. 7 illustrates two panels closing an entrance or egress.

FIG. 7 illustrates two panels closing an entrance (24) or an end egress (32). The panels, as shown in FIG. 7, are not shut completely when in their second position. In an alternative embodiment, such as in high risk or dangerous situations, the panels may be constructed to close completely, even forming an airtight seal if desired. Such an embodiment would be particularly useful for trapping highly dangerous individuals who may have chemicals, weapons, or explosives on their persons.

Figure 8:
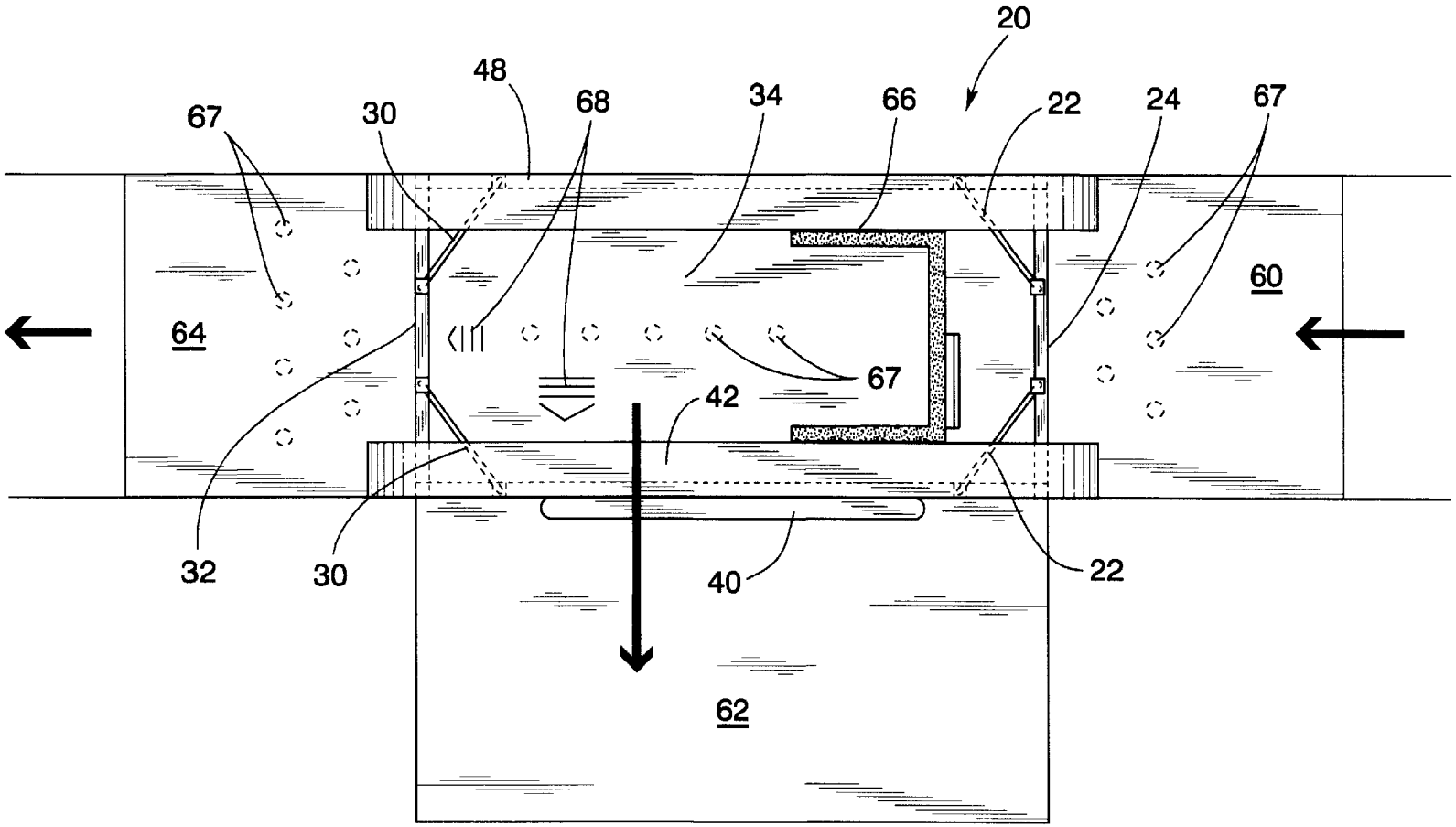
FIG. 8 is a detailed top view of one mobile embodiment of the present invention having fiber optic illuminated instructions in the walkway, metal detector panels, and multiple active position sensors.

FIG. 8 is a detailed top view of one mobile embodiment of the present invention. In certain situations it is desirable to have the rapid access entry/egress apparatus (20) be mobile. An example of one situation would be airport tarmac, where an apparatus (20) could be moved to a variety of places depending on where the airplane was located on the tarmac. In such a situation, the apparatus (20) could be used to screen passengers or workmen who are boarding, loading, or working on the plane. In its mobile embodiment, the present invention would have a first flooring (60) immediately prior to the entrance (24), a second flooring (62) immediately outside the first side egress (42), and a third flooring (64) immediately outside the end egress (32). If the apparatus (20) had a second side egress (52), then a flooring similar to the second flooring (62) would be located just outside that second side egress (52) also. Flooring (60, 62, 64) may contain the position sensors (67) and/or displays (68). Without the flooring, or for installed or permanent apparatuses (20), the position sensors (67) and displays (68) may be set in the floor or sub-floor of a lobby or other building structure that was housing the permanent apparatus (20). The installed or permanent apparatuses (20) may be secured to the floor or sub-flooring using any substrate appropriate anchors, such as lag bolts, nails, screws, etc.

In the current embodiment, the present invention utilizes illuminated displays (68) set in the walkway (34) and/or in the flooring (60, 62, 64) of the apparatus (20) to direct traffic through the apparatus (20). Ideally, the illuminated displays (68) would use symbols to direct traffic instead of words, which may be less universally understood. Such symbols or lighting could be commonly understood colors such as red and green, or arrows, as is shown in FIG. 8. The displays (68) could be implemented in a variety of ways, such as traditional lights or illuminated fiber optics.

FIG. 8 further illustrates the use of an approval means (66), for example metal detector panels. In the current embodiment of the present invention, the approval means (66) would be located within the apparatus (20) to approve or disapprove of any person traveling through the apparatus (20). People traveling through the apparatus (20) who satisfy the approval means (66) would be instructed to travel through the end egress (32) to the secured area (33). People who do not satisfy the approval means (66) would be directed to exit the apparatus (20) through the first side egress (42) or the optional second side egress (52) to a second unsecured area (43). The approval means (66) could be located outside the entrance (24) either on the support structure (48) or as a freestanding device. The approval means (66) may be implemented in a variety of ways including metal detectors, biometric readers, iris scanners, explosive detectors (including, but not limited to, spectrophotometric techniques), physical or facial recognition technology, electronic key locks, mechanical key locks, card readers, finger print or palm readers, vapor analyzers, or any other personal scanner technologies. The approval means (66) could also be password protection technologies.

FIG. 8 also illustrates the use of position sensors (67). In the preferred embodiment of the present invention, these positions sensors (67) are located in the walkway (34) and/or floor immediately outside the entrance (24) and end egress (32). Sensor technologies currently on the market, such as laser curtain sensors, could be employed as position sensors (67). The position sensors (67) could also be located on the support structure (48) or on surrounding structures depending on the technology being used and the user's preferences. The position sensors (67) detect a person's approach to the apparatus (20), passage through the entrance (24), movement across the walkway (34), and exit either through the end egress (32) or the side egress (42, 52). This information is used to determine the timing and movement of the panels.

Figure 9A:
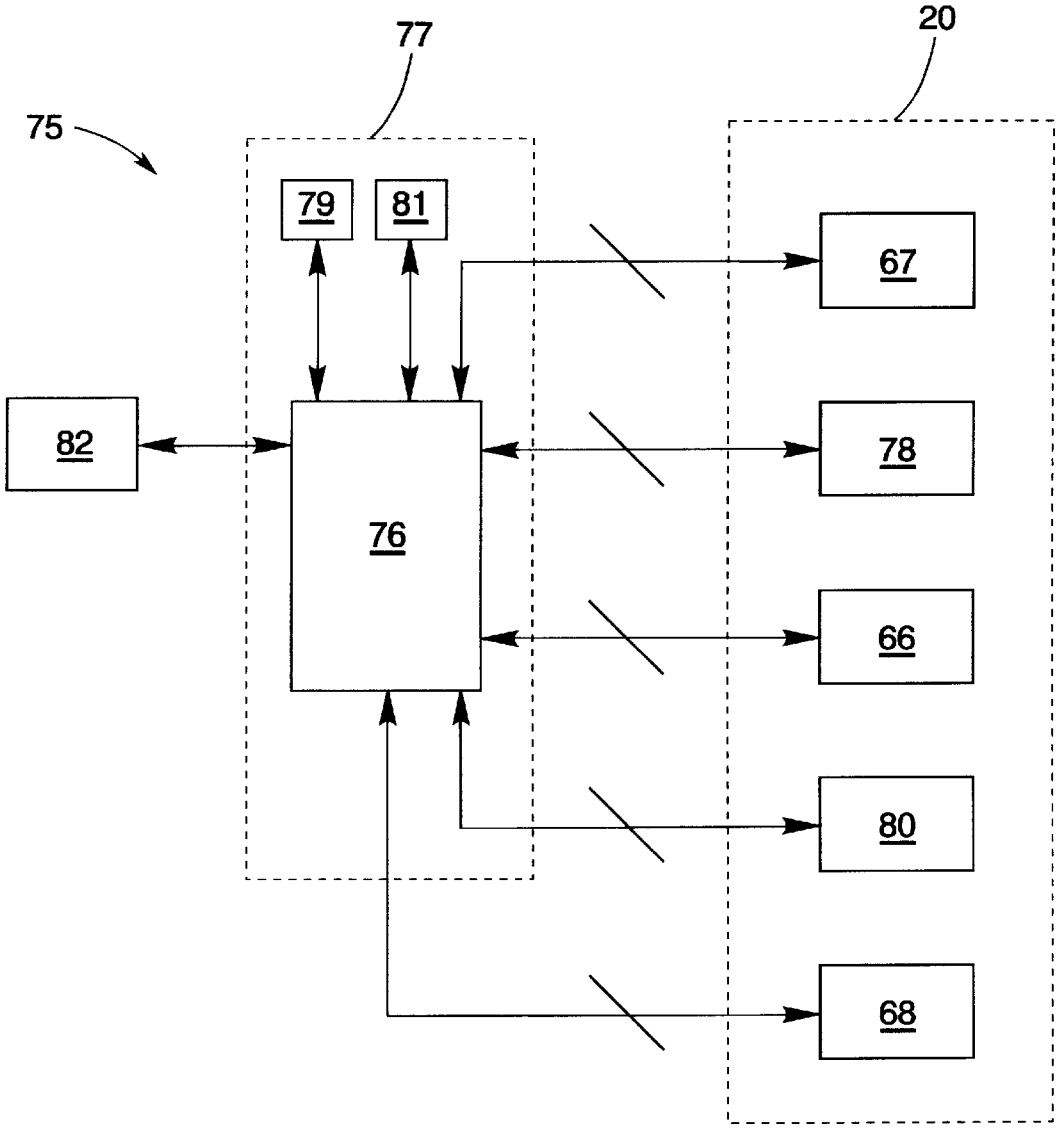
FIG. 9A is a schematic diagram of the control mechanism according to an embodiment of the present invention.
Figure 9B:
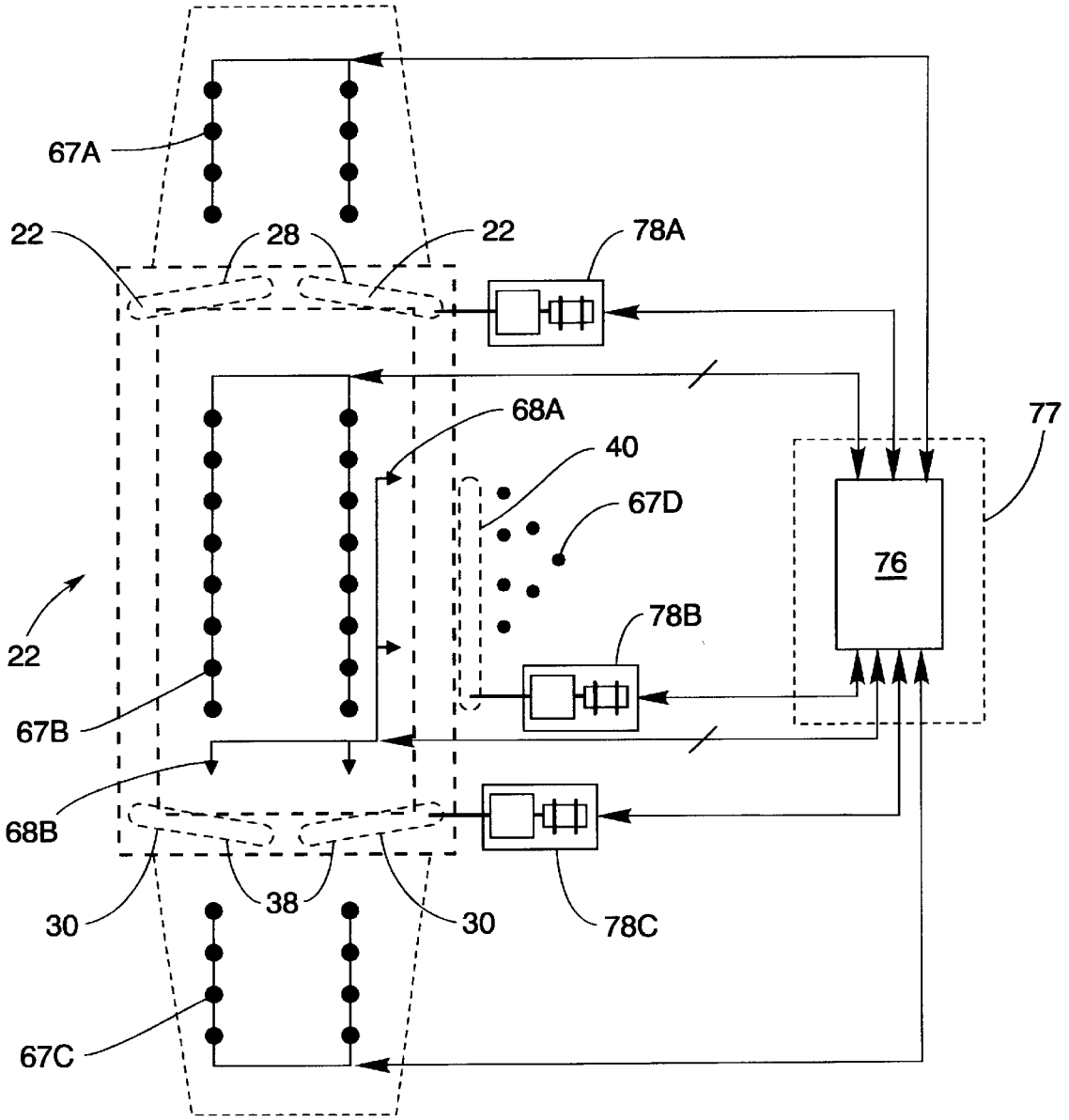
FIG. 9B is a detailed view of the control mechanism according to an embodiment of the present invention.

FIG. 9A is a schematic diagram illustrating a control mechanism (75) for apparatus (20) according to one embodiment of the present invention. FIG. 9B is detailed illustration of the control mechanism (75) of FIG. 9A. Control mechanism (75) includes a computerized station (77), position sensors (67), panel drive units (78), approval means (66), displays (68), and feedback devices (80), among other things.

In the current embodiment, computerized station (77) includes a processor (76), input/output devices (82) (such as a keyboard, printer, monitor, mouse, etc.), memory (79) (such as RAM, ROM, etc.) and a storage device (81) (such as a hard drive, magnetic tape drive, CD-ROM, etc.). Computerized station (77) may be located locally or remotely (for example, in a control room) relative to apparatus (20).

Processor (76) is capable of sending and receiving control signals from input/output device (82), position sensors (67), panel drive units (78), approval means (66), feedback devices (80), and displays (68), among others. Processor (76) is operable to execute a computer program containing instructions related to the desired operation of apparatus (20); the computer program may be downloaded or stored on storage device (81).

In the current embodiment, position sensors (67), as discussed in conjunction with FIG. 8, may include any currently available technologies.

In the current embodiment, panel drive unit (78) is comprised of an electric motor coupled to a gear mechanism. The gear mechanism is connected to one or more panels of apparatus (20) via a mechanic linkage. In operation, the electric motor is activated by the processor (76). The electric motor drives the gear mechanism, which in turn, actuates the panels. It should be noted that other types of drive units might be used while remaining within the scope of the present invention. For example, pneumatic, hydraulic, electrical, and/or electromechanical drive units may be used to actuate the panels of the apparatus (20). Additionally, panel drive units (78) may include one or more position feedback devices (80). In the current embodiment, panel drive units (78) includes a first panel position limit switch and a second panel position limit switch which are activated and transmit a signal to the processor (76) when the corresponding panel is in its first position and second position, respectively. It should be noted that other position feedback devices might be used while remaining within the scope of the present invention.

In the present invention, one panel drive unit (78) can be configured to move all of the panels or a plurality of panel drive units (78) can be employed. Ideally, more than one panel drive unit (78) will be employed in case one should breakdown or if power to the building was interrupted. Auxiliary panel drive units (78) should be used to prevent a person from being trapped within the apparatus (20).

Figure 10:
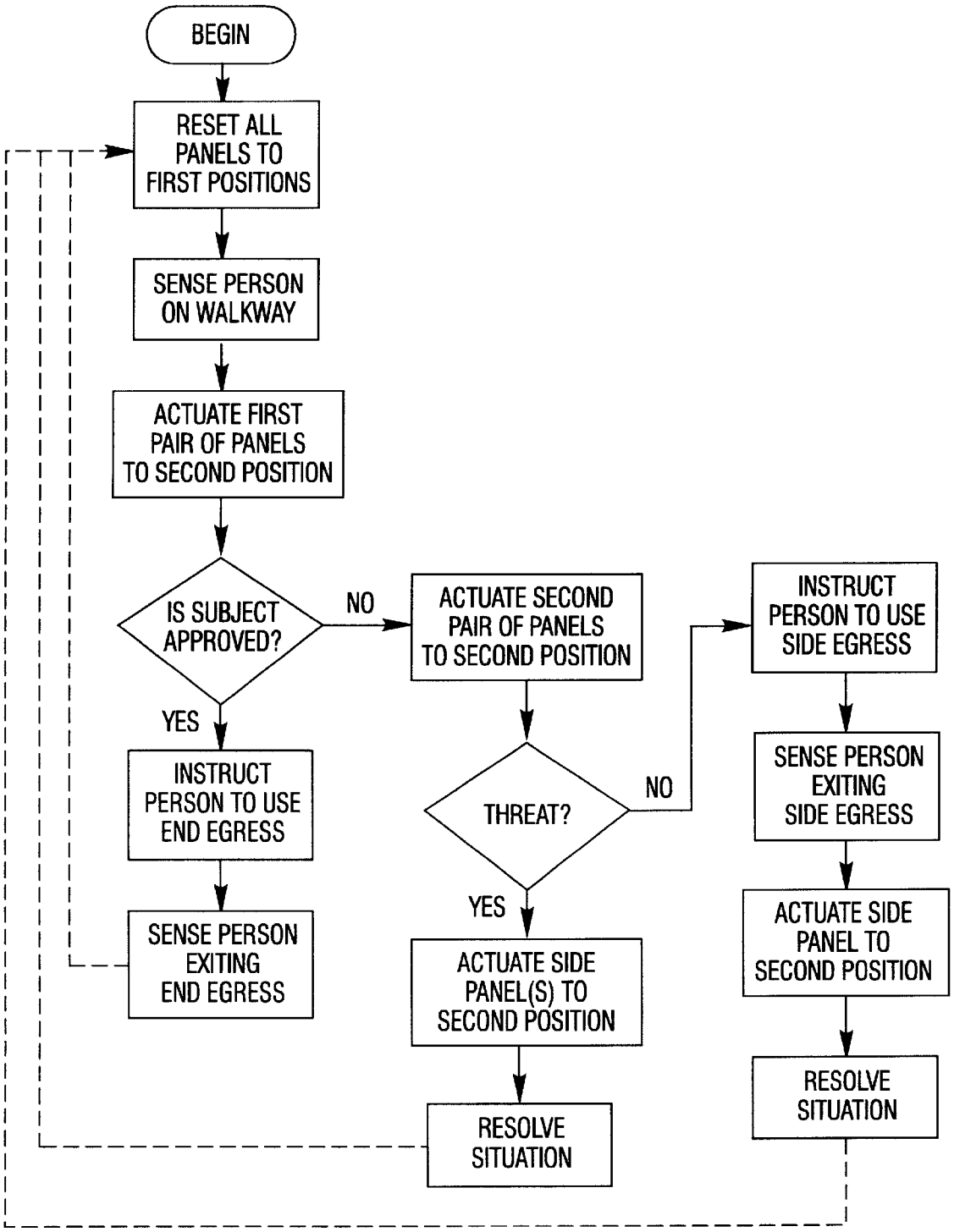
FIG. 10 is a flow chart illustrating the movement of the panels as a person moves through one embodiment of the present invention.

FIG. 9B is a detailed illustration of the control mechanism (75) of FIG. 9A and is better explained in conjunction with FIG. 10, which is a simplified flowchart of one embodiment of the present invention. As a person approaches the apparatus (20), position sensors (67A) sense the person's presence and communicate this to the processor (76). Position sensors (67A) and/or (67B) detect the person's passage through the first pair of panels (22) and communicate that passage to the processor (76). The processor (76) instructs the panel drive unit (78A) to actuate the first pair of panels (22) to their second position (28). The person is approved or not approved via the approval means (66) (not shown). The approval means (66) communicates this information to the processor (76). If the person is approved, the processor (76) instructs the displays (68B) to direct the person to walk through the second pair of panels (30). Position sensors (67B) and/or (67C) detect the person's exit from the apparatus (20) and communicate this information to the processor (76). The processor (76) instructs the panel drive unit (78A) to actuate the first pair of panels (22) to their first position (26).

If the person is not approved, the approval means (66) communicates this information to the processor (76). In some situations, the processor (76) may be configured to instruct the panel drive unit (78B, 78C) to close the egresses and contain the person within the apparatus (20). In other situations, the processor (76) instructs the displays (68A) to direct the person to walk through the side egress and instructs the panel drive unit (78C) to actuate the second pair of panels (30) to their second position (38). The position sensors (67B) and/or (67D) detect when the person has exited through the side egress (42) and communicate this information to the processor (76). The processor (76) directs the panel drive unit (78B) to actuate the first side panel (40) to its second position (46). The first side panel (40) remains closed while the person is in the second unsecured area (43). Once the person is removed from the second unsecured area (43), or the potentially dangerous situation is resolved, the processor instructs the panel drive units (78A, 78B, 78C) to actuate the panels to their respect first positions.

Figure 11:
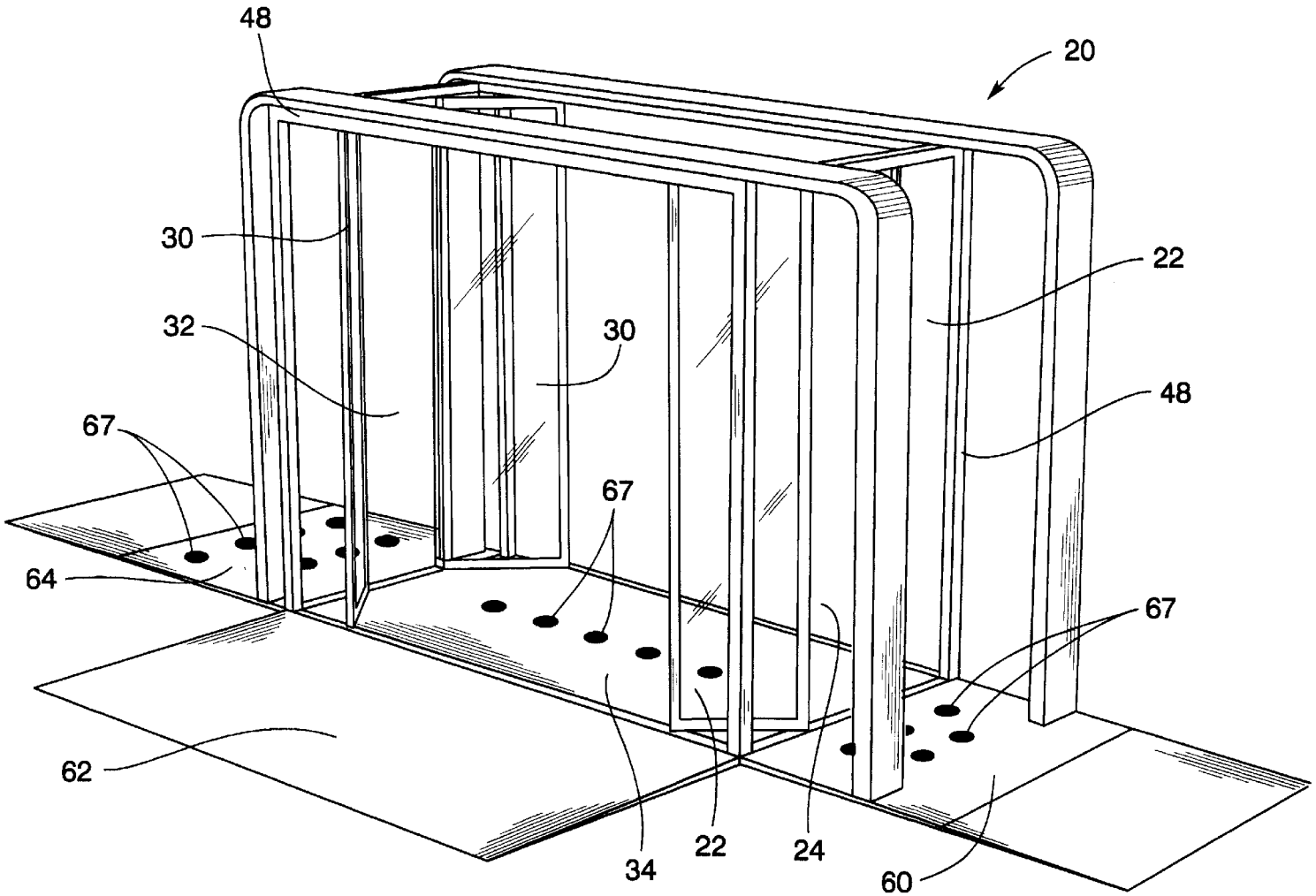
FIG. 11 is a side view of the embodiment of the mobile unit shown in FIG. 8.
Figure 12:
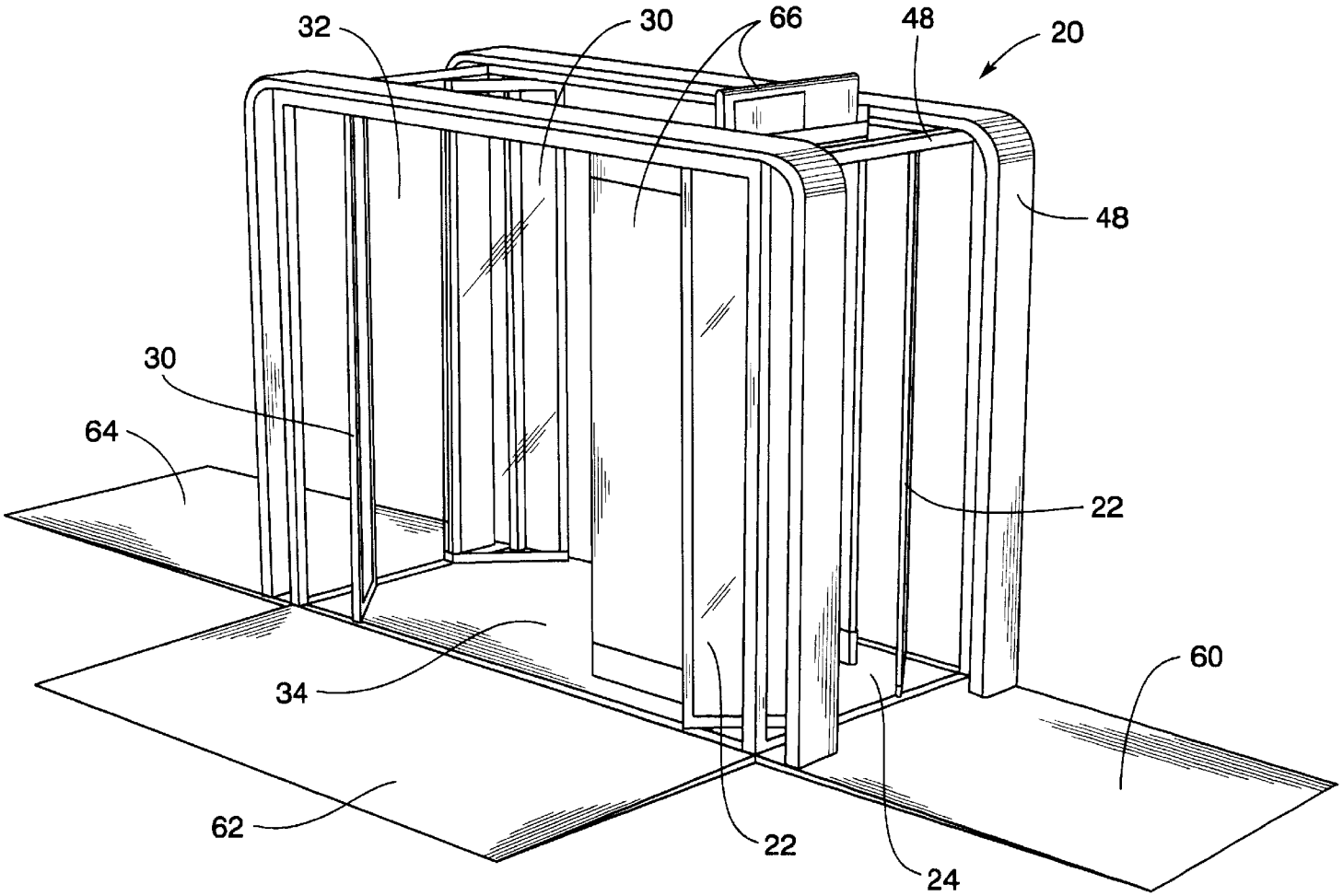
FIG. 12 is a perspective of the mobile embodiment shown in FIGS. 8 and 11.
Figure 13:
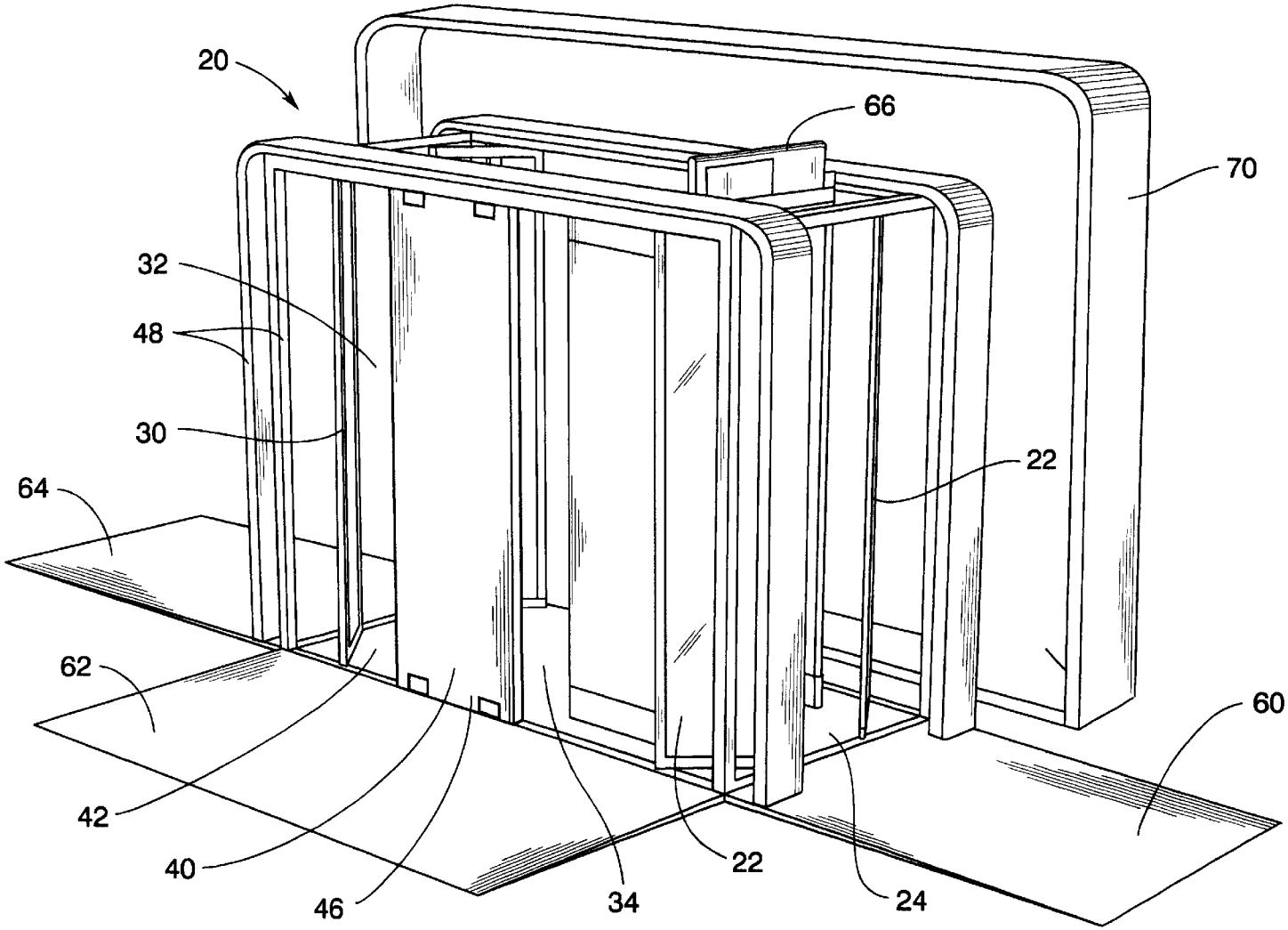
FIG. 13 is a perspective of the mobile embodiment shown in FIGS. 8, 11, 12 with a transparent separator.

FIG. 11 is a side view of the embodiment of the mobile unit shown in FIG. 8. FIGS. 12 and 13 are perspectives of the mobile embodiment shown in FIGS. 8 and 11. FIG. 13 also shows a transparent separator (70). The separator (70) divides the apparatus (20) from any area to the side of the apparatus (20). Ideally, the separator (70) would separate the apparatus (20) from the means for scanning (74) the baggage or personal items of the person passing through the apparatus (20). The means for scanning (74) may be any presently available technology for scanning baggage, luggage, or other items, including, but not limited to, metal detectors, explosive detectors (i.e. spectrophotomic techniques), x-ray technologies, etc.

Figure 14:
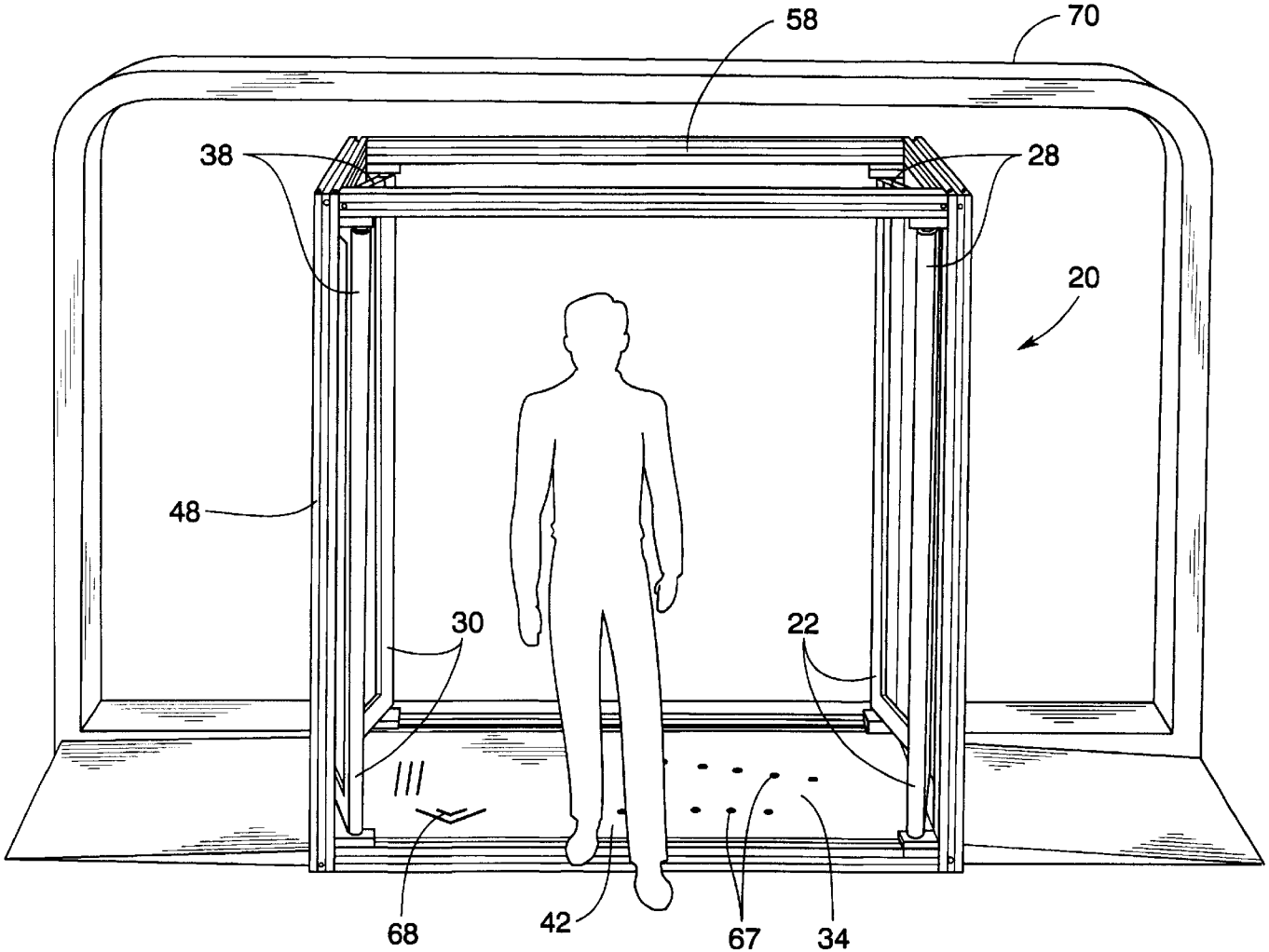
FIGS. 14–17 are perspective views illustrating the present invention in operation.

FIG. 14 shows the apparatus (20) without the first side panel (40) so as to better demonstrate the walkway (34), the display (68) within the walkway (34), the position sensors (67), and the positioning of both pairs of panels (22, 30) in their second positions. FIG. 14 also shows the use of the transparent separator (70). As shown in FIG. 14, one of the advantages of the transparent separator (70) is that a person traveling through the apparatus (20) can see what is going on outside the apparatus (20) and beyond their position. This is particularly important in situations where the transparent separator (70) is being used to divide the apparatus (20) from the scanning area for baggage and for situations in which parents and children are traveling separately through the apparatus (20). The transparent separator (70) allows a person to monitor their baggage and personal items as they are walking through the apparatus (20). The separator (70) also allows people outside the apparatus (20) to monitor what is happening inside the apparatus (20). The thick edge structure of the separator (70) also makes it an ideal surface along which to run wires and electrical elements to the apparatus (20). Additionally, approval means (66) such as facial recognition technologies can be attached the edge of the separator (70) proximate to the entrance (24). FIG. 14 also offers a more detailed view of the channels (58) that run along the support structure (48) restricting the movement of the panels.

Figure 15:
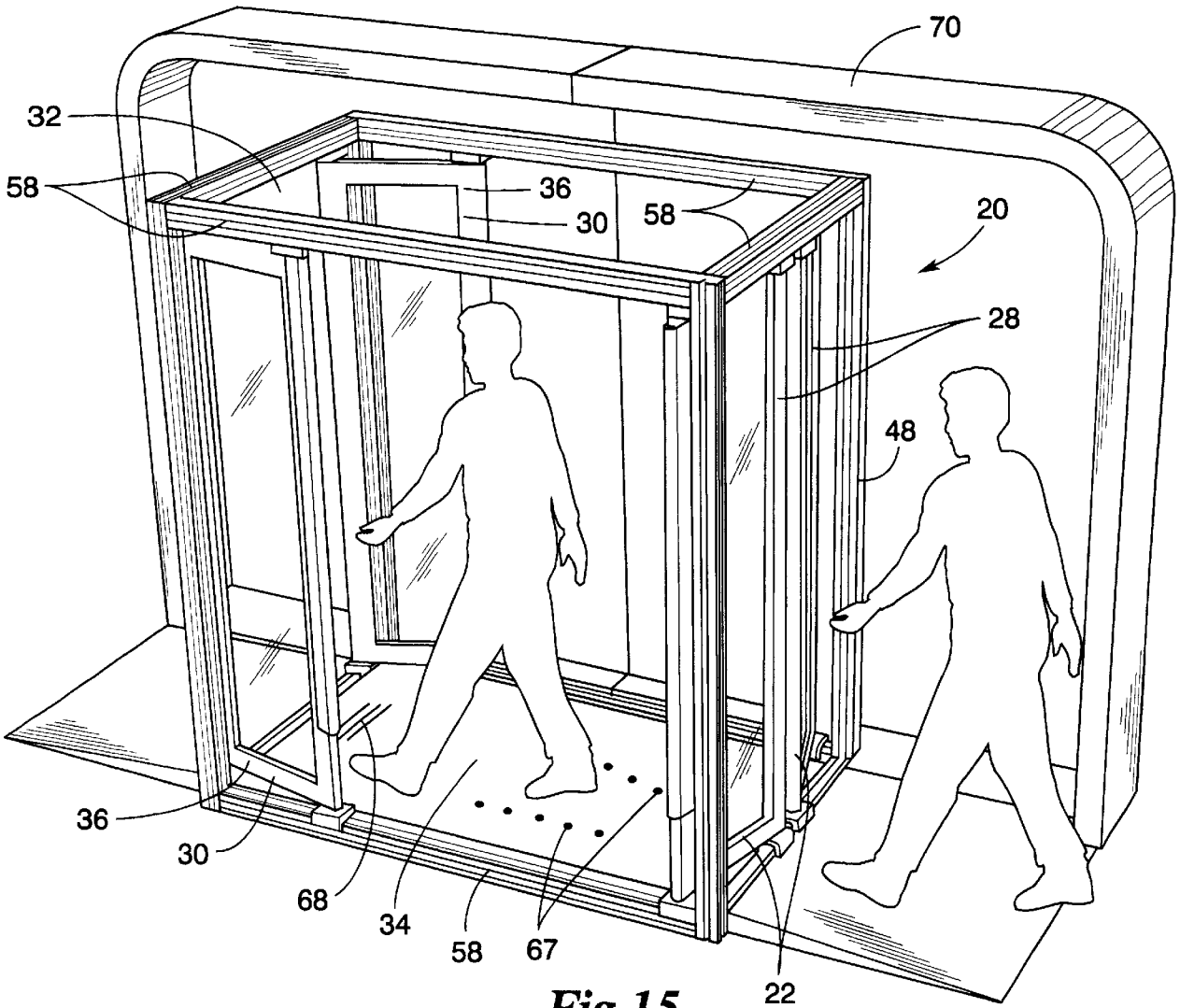
Figure 16:
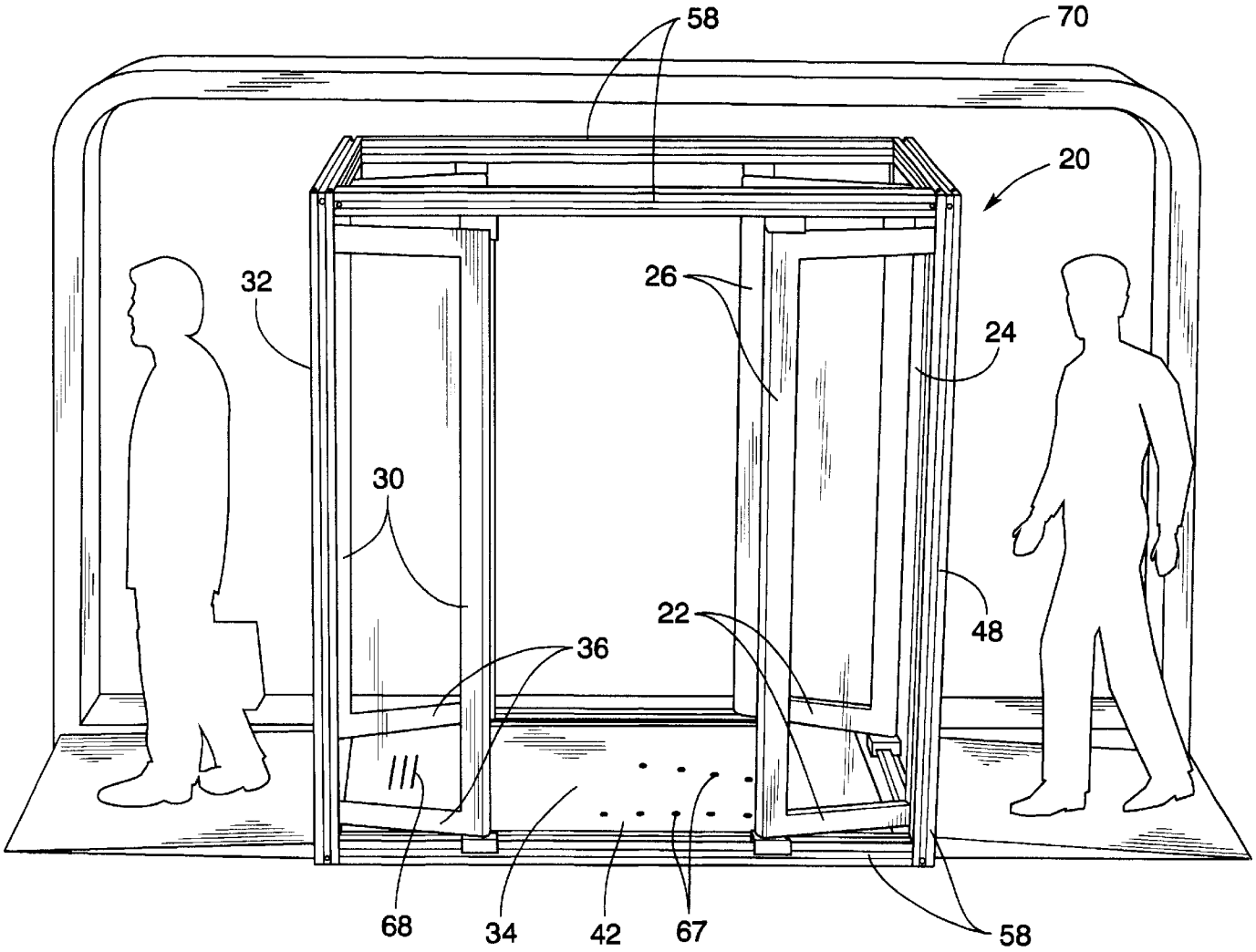
Figure 17:
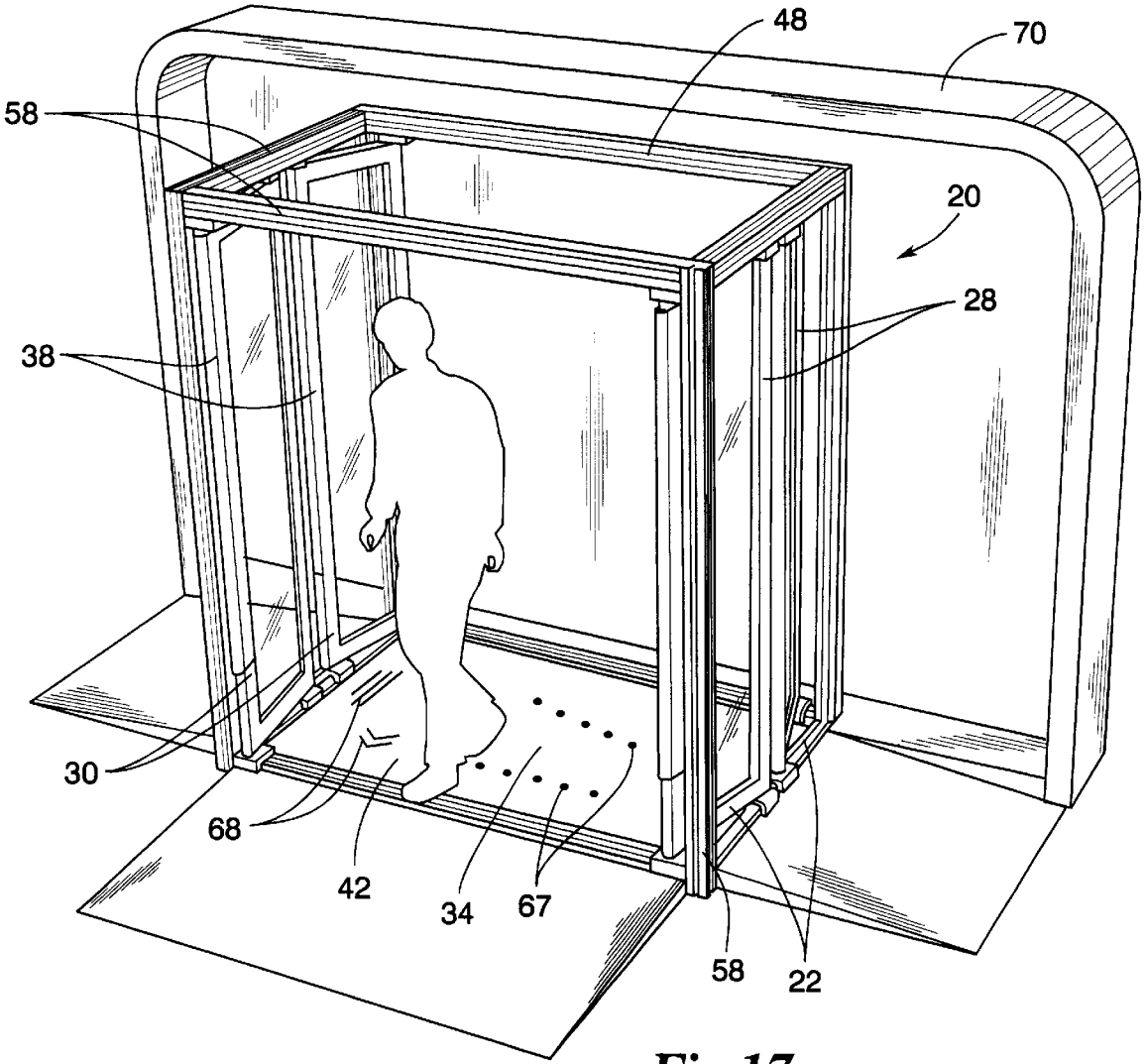

FIGS. 15–17 illustrate a method of controlling the movement of traffic by moving panels between first and second positions. FIG. 15 shows the first pair of panels (22) in their second position (28), thereby preventing the people in the queue from passing through the entrance (24) before the person on the walkway (34) exits the apparatus (20) through the end egress (32) or through a side egress.

FIG. 16 shows the first pair of panels (22) and the second pair of panels (30) in their respective first positions when no one is on the walkway (34) and a person approaches the entrance (24). Also, although not shown, the first side egress (42) would be open or unrestricted at this time. FIG. 17 shows both the first pair of panels (22) and the second pair of panels (30) in their respective second positions, thus forcing a person through the first side egress (42) to the second unsecured area (43).

Figure 18:
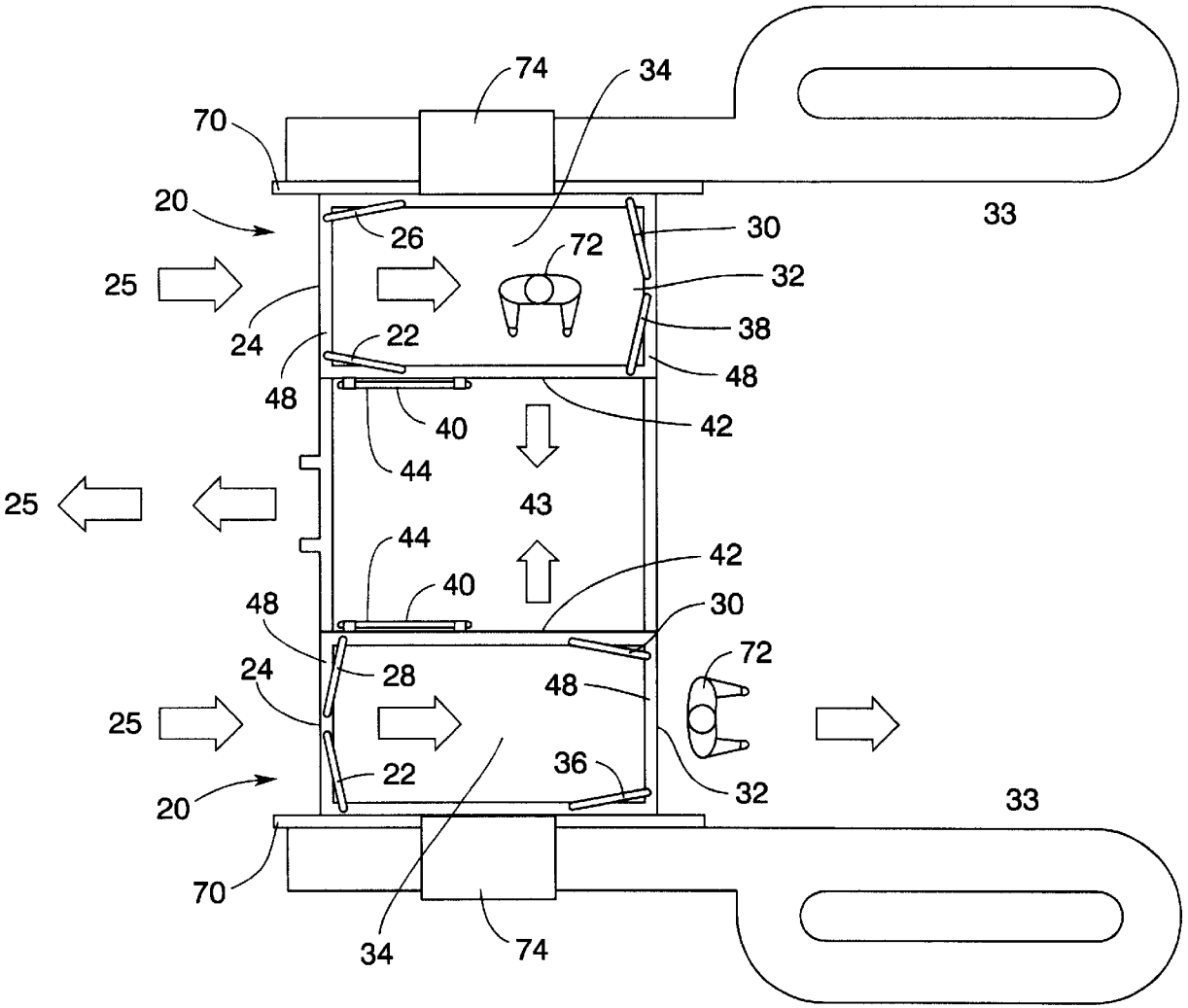
FIG. 18 demonstrates the use of one embodiment of the present invention with container or baggage scanners to process people and their items.

FIG. 18 demonstrates the use of one embodiment of the present invention as a system for processing people (72) and their belongings from a first unsecured area (25) to a secured area (33). In the preferred embodiment of the present invention, people (72) and their luggage are processed at the same rate; thus, a person passing through the apparatus (20) would exit the end egress (32) just as his or her baggage or personal items were exiting the means for scanning (74).

The above-described embodiments of the invention are intended to be illustrative only. Those skilled in the art may devise numerous alternative embodiments without departing from the scope of the following claims. For example, other types of panels, doors, and door-like structures may be used; a conveyor belt or moving walkway may be substituted for a stationary walkway; and the concepts of the present invention may be incorporated into other types of access control systems without departing from the present invention, which is limited only by the following claims

What is claimed is:

1. An apparatus, comprising:

a first pair of end barriers defining an entrance, said first pair of end barriers movable between a first position in which said entrance is open and a second position in which said entrance is blocked;

a second pair of end barriers defining an end egress located opposite and spaced apart from said entrance so as to define a walkway therebetween, said second pair of end barriers movable between a first position in which said end egress is open and a second position in which said end egress is blocked;

a first side barrier defining a first side egress relative to said walkway, said first side barrier movable between a first position in which said first side egress is open and a second position in which said first side egress is blocked; and a support structure for holding all of said barriers an upright manner and for facilitating movement of all of said barriers between said barriers' respective first and second positions, wherein at least one of said barriers is a panel and wherein said support structure includes one or more channels operable to constrain the movement of said panel.

2. The apparatus of claim 1, further comprising a second side barrier defining a second side egress opposite from said first side egress relative to said walkway, said second side barrier movable between a first position in which said second side egress is open and a second position in which said second side egress is blocked.

3. The apparatus of claim 1, further comprising at least one approval means carried by said support structure so as to be located proximate to said walkway.

4. The apparatus of claim 1, further comprising at least one approval means located between said first pair of end barriers and said second pair of end barriers.

5. The apparatus of claim 4, wherein said approval means is one of a metal detector, an explosives detector, a biometrics reader, physical recognition technology, an electronic key lock, a mechanical key lock, a card reader, a finger print reader, facial recognition technology, a hand reader, a vapor analyzer, a spectrophotometric technique, and an iris scanner.

6. The apparatus of claim 4, further comprising:

at least one position sensor located prior to said entrance;

at least one position sensor located along said walkway;

at least one position sensor located beyond said first side egress; and at least one position sensor located beyond said end egress.

7. The apparatus of claim 6, further comprising at least one barrier drive unit for moving at least one of said first pair of end barriers, said second pair of end barriers, and said first side barrier.

8. The apparatus of claim 7, further comprising a processor connected to said approval means, said position sensors, and said at least one barrier drive unit.

9. The apparatus of claim 8, additionally comprising an auxiliary barrier drive unit for moving at least one of said first pair of end barriers, said second pair of end barriers, and said first side barrier.

10. The apparatus of claim 8, additionally comprising at least one feedback device connected to said processor and to said at least one barrier drive unit for determining the position of all of said barriers.

11. The apparatus of claim 6, wherein said position sensor located beyond said end egress includes active laser curtain sensors.

12. The apparatus of claim 1, further comprising:

a first flooring located immediately prior to said entrance;

a second flooring located immediately beyond said first side egress; and a third flooring located immediately beyond said end egress.

13. The apparatus of claim 12, further comprising:

at least one position sensor located in said first flooring;

at least one position sensor located in said walkway;

at least one position sensor located in said second flooring; and at least one position sensor located in said third flooring.

14. The apparatus of claim 1, wherein said apparatus is secured to a floor using a plurality of anchors.

15. The apparatus of claim 1, wherein all of said barriers are comprised of a polycarbonate laminate.

16. The apparatus of claim 1, wherein all of said barriers are transparent.

17. The apparatus of claim 1, wherein all of said barriers are constructed of a bullet resistant material.

18. The apparatus of claim 1, wherein all of said barriers are constructed of an explosion resistant material.

19. The apparatus of claim 1, further comprising a display located in said walkway for providing instructions.

20. The apparatus of claim 19, wherein said display includes fiber optic illuminated signs.

21. The apparatus of claim 1, further comprising a means for securing all of said barriers in their respective second positions.

22. The apparatus of claim 1, further comprising a plurality of sensors located on one or more edges of at least one barrier.

23. The apparatus of claim 1, wherein said walkway is a conveyor belt.

24. The apparatus of claim 1, further comprising a transparent separator located along a side of said walkway opposite said first side barrier, and spanning at least the length of said apparatus.

25. The apparatus of claim 1, wherein said support structure is comprised of one of a thermoset polymer composite, an elastomeric polymer composite, a thermoplastic polymer composite, a non-reinforced polymer, and a metal-plastic hybrid.

26. An apparatus, comprising:

a first pair of panels defining an entrance, said first pair of panels movable between a first position in which said entrance is open and a second position in which said entrance is blocked;

a second pair of panels defining an end egress located opposite and spaced apart from said entrance so as to define a walkway therebetween, said second pair of panels movable between a first position in which said end egress is open and a second position in which said end egress is blocked;

a support structure for holding said first pair of panels and said second pair of panels in an upright manner and for facilitating movement of said first and second pairs of panels between said first and second pairs of panels' respective first and second positions, wherein said support structure-includes one or more channels operable to constrain the movement of at least one of said first pair of panels and said second pair of panels;

a first side panel defining one edge of a first side egress from said walkway, said first side panel movable between a first position in which said first side egress is open and a second position in which said first side egress is blocked; and means for supporting said first side panel in an upright position.

27. A system comprising:

a first pair of end barriers defining an entrance, said first pair of end barriers movable between a first position in which said entrance is open and a second position in which said entrance is blocked, said first pair of end barriers connecting a walkway with a first unsecured area;

a second pair of end barriers defining an end egress located opposite said entrance at the end of said walkway, said second pair of end barriers movable between a first position in which said end egress is open and a second position in which said end egress is blocked, said second pair of end barriers connecting said walkway with a secured area; and a first side barrier defining one edge of a first side egress from said walkway, said first side barrier movable between a first position in which said first side egress is open and a second position in which said first side egress is blocked, said first side barrier connecting said walkway with a second unsecured area, wherein the movement of at least one of said first pair of end barriers, said second pair of end barriers, and said first side barrier is constrained by one or more channels.

28. The system of claim 27, further comprising a means for approving a person while said person is in said first unsecured area.

29. The system of claim 27, further comprising a means for approving a person while said person is on said walkway.

30. The system of claim 27, further comprising a means for securing said barriers in their respective second positions, thereby trapping a person within said barriers.

31. The system of claim 27, further comprising a means for scanning items carried by a person, said means for scanning located along the side of said walkway opposite said first side egress.

32. The system of claim 31, further comprising a transparent separator located between said walkway and said means for scanning said separator spanning at least the length of said walkway.

33. The apparatus of claim 27, wherein said barriers are one of a panel, a door, a turnstile, a revolving door, a moving bar, and a gate.

34. The apparatus of claim 1 wherein said apparatus is used in an outdoor environment.

* * * * *

UNITED STATES PATENT AND TRADEMARK OFFICE

CERTIFICATE OF CORRECTION

PATENT NO. : 6,745,520 B2
DATED : June 8, 2004
INVENTOR(S) : Puskaric et al.

It is certified that error appears in the above-identified patent and that said Letters Patent is hereby corrected as shown below:

Column 9,
Line 48, delete “electromechanical” and insert therefore -- electro-mechanical --.

Column 10,
Line 28, delete “respect” and insert therefore -- respective --.
Line 63, after “attached” and before “the” insert -- to --.

Column 11,
Line 33, insert a period after “claims”.
Line 52, after “barriers” and before “an” insert -- in --.

Column 14,
Line 37, delete the comma after “27”.

Signed and Sealed this

Twenty-eighth Day of September, 2004

JON W. DUDAS
*Director of the United States Patent and Trademark Office*